US007305787B1

(12) United States Patent
Stratbucker

(10) Patent No.: US 7,305,787 B1
(45) **Date of Patent: *Dec. 11, 2007**

(54) SYSTEMS AND METHODS FOR INCAPACITATION USING BIOFEEDBACK

(75) Inventor: Robert A. Stratbucker, Omaha, NE (US)

(73) Assignee: TASER International, Inc., Scottsdale, AZ (US)

( * ) Notice: Subject to any disclaimer, the term of this patent is extended or adjusted under 35 U.S.C. 154(b) by 302 days.

This patent is subject to a terminal disclaimer.

(21) Appl. No.: 10/971,983

(22) Filed: Oct. 23, 2004

Related U.S. Application Data

(63) Continuation-in-part of application No. 10/631,683, filed on Jul. 30, 2003, now Pat. No. 6,898,887.

(60) Provisional application No. 60/399,643, filed on Jul. 31, 2002.

(51) Int. Cl.
*F41B 15/04* (2006.01)

(52) U.S. Cl. ..... 42/1.08; 42/84

(58) Field of Classification Search ..... 42/84, 42/1.08; 89/1.11
See application file for complete search history.

(56) References Cited

U.S. PATENT DOCUMENTS

| | | | | |
|---|---|---|---|---|
| 3,803,463 | A | 4/1974 | Cover | 361/232 |
| 3,971,292 | A | 7/1976 | Paniagua | 89/1.11 |
| 4,852,454 | A | 8/1989 | Batchelder | 89/1.11 |
| 4,884,809 | A | 12/1989 | Rowan | 463/47.3 |
| 5,654,867 | A | 8/1997 | Murray | 361/232 |
| 5,655,540 | A | 8/1997 | Seegobin | 128/702 |
| 5,831,199 | A | 11/1998 | McNulty, Jr. et al. | 89/1.11 |
| 5,954,664 | A | 9/1999 | Seegobin | 600/515 |
| 5,962,806 | A | 10/1999 | Coakley et al. | 102/502 |
| 6,223,073 | B1 | 4/2001 | Seegobin | 600/515 |
| 6,253,102 | B1 * | 6/2001 | Hsu et al. | 600/515 |
| 6,636,412 | B2 | 10/2003 | Smith | 361/232 |
| 6,898,887 | B1 * | 5/2005 | Stratbucker | 42/1.08 |
| 2001/0012918 | A1 | 8/2001 | Swanson | 600/510 |

* cited by examiner

*Primary Examiner*—Stephen M. Johnson
(74) *Attorney, Agent, or Firm*—William R. Bachand

(57) ABSTRACT

A system and method provide immediate monitoring of a physiological function, such as ECG, of a subject before, during, or after application of an electric shock intended to temporarily incapacitate the subject. The electric shock may be delivered via at least one electrode ballistically implanted into the subject's skin. Systems and methods may further include performing time domain and/or frequency domain analysis of the results of monitoring, recording results of monitoring and/or analysis, and preventing follow-on shocks, or altering energy characterizing parameters of follow-on electric shocks so as to lessen the risk of injury to the subject, such as cardiac malfunction.

31 Claims, 1 Drawing Sheet

SYSTEMS AND METHODS FOR INCAPACITATION USING BIOFEEDBACK

This Application is a CIP of Patent Application Ser. No. 10/631,683 by Stratbucker, filed Jul. 30, 2003, now U.S. Pat. No. 6,898,887 which claims benefit of Provisional Patent Application Ser. No. 60/399,643 by Stratbucker, filed Jul. 31, 2002.

TECHNICAL FIELD

Embodiments of the present invention generally relate to monitoring of a physiological function in a subject, and more particularly to immediate monitoring of a physiological function of a subject after application of an electric shock to the subject. Shock may be applied via at least one electrode ballistically implanted in the subject. Methods may include performing time domain and/or frequency domain analysis of data, storing data, and altering a characterizing parameter of a follow-on electric shock (so as to lessen the risk of injury to the subject).

BACKGROUND

Commonly, electro-immobilization devices (such as TASER® systems marketed by TASER International, Inc. and stun guns) deliver electric shocks to subjects. These devices may be used by security personnel to control recalcitrant persons. Recently, however, some questions have been raised about effects of the delivery of an electric shock to a subject on the subject's cardiac function. For instance, there is increased speculation that cardiac function is disrupted by application of an electric shock. It would therefore provide utility if substantially simultaneously, or at a relatively short time after delivery of a shock to a subject, a physiological function of the subject could be monitored and documented in data storage media.

U.S. Pat. No. 5,831,199 to McNulty et al. describes a weapon for immobilization and capture. U.S. Pat. No. 5,654,867 to Murray describes an immobilization weapon. U.S. Pat. No. 4,884,809 to Rowan describes an interactive transector device which provides for monitoring an individual's electrocardiogram (ECG). Published U.S. Patent Application 2001/0012918 by Swanson describes utilizing electrical energy pulses to temporarily stun a zone of tissue of a patient. Swanson mentions monitoring ECGs of the patient U.S. Pat. Nos. 6,223,073, 5,954,664 and 5,655,540 to Seegobin describe breaking ECG data into frequency bands for analysis. U.S. Patents identified by the Examiner during examination of the parent Patent Application, Ser. No. 10/631,683, include: U.S. Pat. Nos. 3,803,436 to Cover, 5,962,806 to Coakley et al., 4,852,454 to Batchelder, 3,971,292 to Paniagua, and 6,636,412 to Smith.

There is a need for systems and methods for applying temporarily incapacitating electric shocks via ballistically implanted electrode(s), and simultaneously or after a short period, monitoring physiological parameters via the same electrode(s), then using the monitored physiological parameters for altering characterizing parameters of follow-on temporarily incapacitating electric shocks administered to the subject for the purpose of lessening the risk of injury to the subject.

SUMMARY

According to an aspect of the present invention, monitoring a cardiac function of a subject before, during, or after application of an electric shock to the subject may be accomplished using the same electrode(s) that delivered the electric shock.

According to another aspect of the present invention, an electric shock delivery system monitors a cardiac function of a subject before, during, or after application of an electric shock by the system using the same electrode(s) that delivered the electric shock.

According to another aspect of the present invention, an electric shock delivery system monitors physiological parameter(s) of a subject before, during, or after application of an electric shock to the subject by the system using the same electrode(s) that delivered the electric shock and alters characterizing parameters (e.g., frequency, duty cycle, pulse energy content, pulse patterns and the like) of follow-on applied electrical energy, that may be determined to be necessary to temporarily incapacitate the subject if additional shocks are applied, on the basis of the monitored physiological parameters so as to lessen the risk of injury to the subject.

According to yet another aspect of the present invention, an electric shock delivery system monitors a cardiac function resulting in ECG data of a subject before, during, or after application of an electric shock to the subject by the system using the same electrode(s) that delivered the electric shock and ceases application of additional shocks in accordance with time domain and/or frequency domain analysis of the ECG data.

DETAILED DESCRIPTION

Figure 1:
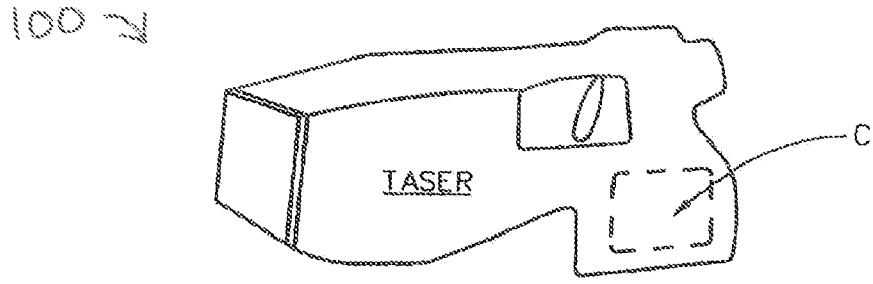
FIG. 1 is a perspective view of an electric shock delivery system according to various aspects of the present invention.

The present invention includes both systems and methods for immediate monitoring of stimulus-shock modulated physiological functions (such as ECG and fibrillation threshold) as well as assessing stimulus-shock modulated biophysical parameters (such as specific conductance and electrode impedance) after these functions and parameters have been perturbed from normal by an imposition of complex time-variant electric fields on nerves, muscles, and other sensitive body tissues in the vicinity of one or more ballistically impressed or implanted body surface electrodes. Further, the present invention includes constructive use of these functions and parameters in electronic tailoring of stimulus-shock waveforms to optimize system performance before and/or during intentional electrical incapacitation of subjects, while concomitantly minimizing the risk of untoward outcomes of such efforts. That is, based upon the results of monitoring physiological parameters of a subject before and/or after delivery of an electric shock to the subject for the purpose of temporarily incapacitating him or her, the characterizing parameters (e.g., frequency, duty cycle, pulse energy content, pulse patterns and the like) of follow-on electric shocks may be altered so as to lessen the risk of injury to the subject, such as cardiac malfunction.

TASER® systems are known electric shock delivery systems that deliver electric shocks to subjects via ballistically implanted (preferably into the subject's skin), tethered electrodes. An exemplary embodiment of the present invention substantially simultaneously, or after some small time, uses the circuit provided by implanted electrodes of an electric shock delivery system to monitor cardiac function and store ECG data via additional circuitry that is functionally integrated into an otherwise conventional electric shock delivery system.

A system, according to the present invention, for delivery of an electric shock to a subject via at least one electrode implanted into the subject includes means for monitoring a physiological function of the subject via the electrode. Monitoring the physiological function includes monitoring cardiac function resulting in ECG data. Monitoring is accomplished via the electrode that is ballistically implanted into the subject in a manner of the type performed by a TASER® system.

A particularly relevant embodiment of the present invention includes a TASER® system for delivery of a temporarily incapacitating electric shock to a subject via at least one tethered electrode that is ballistically implanted into the subject by the system. The embodiment further includes means for monitoring cardiac function resulting in ECG data via the electrode, and means for preventing follow-on electric shocks, or altering the characterizing parameters of follow-on temporarily incapacitating electric shocks administered to the subject so as to lessen the risk of injury to the subject. Alteration is based on the resulting ECG data before, during or after delivery of an electric shock to the subject. The embodiment further includes storage means for recording data pertaining to the resulting ECG data obtained via the electrode.

A basic method for providing a record of a subject's physiological function substantially simultaneously with, or a short time after delivery of an electric shock to the subject includes the step of: (a) providing a system for delivery of an electric shock to a subject via at least one electrode implanted into the subject, the system including means for monitoring a physiological function of via the electrode; (b) causing the system to implant at least one electrode into the subject; (c) before, substantially simultaneously with, or a short time after delivery of an electric shock by the system to the subject, utilizing the circuit established by the electrode to monitor a physiological function of the subject; and (d) storing data resulting from monitoring the physiological function in memory integrated into the system. In a particularly relevant embodiment of the method, the system is of the type known as a TASER® system and the system further includes means for preventing follow-on shocks, or altering the characterizing parameters of follow-on electric shocks so as to lessen the risk of injury to the subject based on the data resulting from monitoring the physiological function of the subject during or after delivery of the electric shock to the subject. The preferred embodiment further includes means for recording the data.

Another method of the present invention for temporarily incapacitating a subject includes the steps of: (a) providing a system of the type known as a TASER® system for delivery of a temporarily incapacitating electric shock to a subject via at least one tethered electrode ballistically implanted into the subject by the system, wherein the system includes means for monitoring a cardiac function resulting in ECG data via the electrode and means for preventing follow-on electric shocks, or altering the characterizing parameters of follow-on temporarily incapacitating electric shocks administered to the subject so as to lessen the risk of injury of the subject based on the ECG data of the subject during or after delivery of an electric shock to the subject; (b) causing the system to ballistically implant at least one tethered electrode onto the subject; (c) before, substantially simultaneously with or a short time after delivery of an electric shock by the system to the subject, utilizing the circuit established by the electrode to monitor a cardiac function of the subject resulting in ECG data; and (d) based upon the ECG data, preventing application of shocks, or causing the means for altering to alter characterizing parameters to follow-on temporarily incapacitating electric shocks administered to the subject so as to lessen the risk of injury to the subject. The method preferably further includes providing in the system a storage means for recording ECG data, and causing it to record the ECG data.

The present invention includes a system for delivery of an electric shock to a subject via at least one electrode ballistically implanted into the subject, the system including means for monitoring a physiological function of the subject via the electrode, means for performing time domain and/or frequency domain analysis of a result of monitoring, and means for storing the results of the analysis. The physiological function monitored can be a cardiac function resulting in data in the form of ECG data. The electrode is ballistically implanted into the subject by the system for temporarily incapacitating the subject in a manner of the type performed by a TASER® system. The system of the present invention includes means for preventing follow-on electric shocks, or altering the characterizing parameters of follow-on electric shocks so as to lessen the risk of injury to the subject, based on a monitored physiological function of the subject during or after delivery of an electric shock to the subject, and based on time domain and/or frequency domain analysis of a result of monitoring. The results of analysis include data in at least two frequency ranges. The stored results of the analysis are formatted to include the time domain and frequency domain ECG data in the two frequency bands.

Another system of the present invention includes a system for delivery of a temporarily incapacitating electric shock to a subject via at least one tethered electrode ballistically implanted into the subject by the system in a manner of the type performed by a TASER® system. The system of the present invention includes means for monitoring a cardiac function resulting in ECG data via the electrode; and means for analyzing the ECG data and, based thereupon, preventing follow-on electric shocks or altering the characterizing parameters of follow-on temporarily incapacitating electric shocks administered to the subject so as to lessen the risk of injury to the subject. The alteration can be based on the ECG data monitored during or after delivery of an electric shock to the subject. The system further includes storage means for recording data pertaining to the ECG data. The system may further include means for performing time domain and/or frequency domain analysis of the ECG data and recording results thereof in the storage means.

Another method of the present invention provides a record of a physiological function of a subject substantially simultaneously with, or a short time after deliver of an electric shock to the subject. The method includes the steps of: (a) providing a system for delivery of the electric shock to the subject via at least one electrode implanted into the subject, wherein the system includes means for monitoring a physiological function of the subject via the electrode to produce results of monitoring, means for analyzing the results of monitoring, and storage means for recording the results of monitoring and the results of analyzing; (b) causing the system to implant at least one electrode onto the subject; (c) before, substantially simultaneously with, or a short time after delivery of the electric shock by the system to the subject, utilizing the circuit established by the electrode to monitor a physiological function of the subject; (d) performing time domain analysis and/or frequency domain analysis of the results of monitoring; and (e) recording the results of analysis in the storage means. Providing a system may include providing a system that further includes means for preventing follow-on shocks, or altering the characterizing parameters of follow-on electric shocks so as to lessen the risk of injury to the subject based on the results of monitoring. Recording may include recording data pertaining to monitoring a cardiac function resulting in ECG data.

Another method of the present invention accomplishes temporarily incapacitating a subject. The method includes the steps of: (a) providing a system for delivery of a temporarily incapacitating electric shock to a subject via at least one tethered electrode ballistically implanted into the subject by the system in a manner of the type performed by a TASER® system, wherein the system includes means for monitoring a cardiac function resulting in ECG data via the electrode and means for preventing follow-on electric shocks, or altering the characterizing parameters of follow-on temporarily incapacitating electric shocks administered to the subject based on the ECG data during or after delivery of the electric shock to the subject; (b) causing the system to ballistically implant the at least one tethered electrode onto the subject; (c) before, substantially simultaneously with, or a short time after delivery of the electric shock by the system to the subject, utilizing the circuit established by the electrode to monitor a cardiac function of the subject resulting in ECG data, and analyzing the ECG data in the time domain and/or the frequency domain; and (d) based upon the ECG data and analysis thereof, preventing electrical shocks or causing the means for preventing or altering to alter characterizing parameters of follow-on temporarily incapacitating electric shocks administered to the subject so as to lessen the risk of injury to the subject.

It is to be understood that the terminology "at least one electrode" includes two embodiments. First, two electrode are implanted into a subject to complete a circuit through the subject. Second, one electrode is implanted into a subject and an earth ground path completes the circuit through the subject.

The terminology "tethered" is to be understood to mean that ballistically implanted electrodes are attached to a body from which they were ejected and are electrically coupled by conductive means such as wires as in a TASER® system.

The terminology "implanted" is to be interpreted to accomplish an electrical function. That is, implanting includes an electrode implanted in a subject's skin (preferred) and an electrode affixed to a subject, such as in clothing, to apply an electrical shock to a subject, and to monitor a physiological function of a subject.

Finally, it is emphasized that modifying follow-on shocks can include preventing all shocks, or ceasing applying further shocks, for instance in the case where time domain and/or frequency domain data indicates it appropriate. In this light it is noted that there is no documented case of a TASER® system inducing immediate fibrillation in a subject; but, should a system of the present invention detect that a subject has, for instance, preexisting cardiac problems, the system of the present invention can be programmed to cease applying additional shocks.

Turning now to the drawing, FIG. 1 illustrates a system 100 of the present invention that includes a TASER® system and circuitry C. Not shown are electrodes and propelling means therefor.

Figure 2:
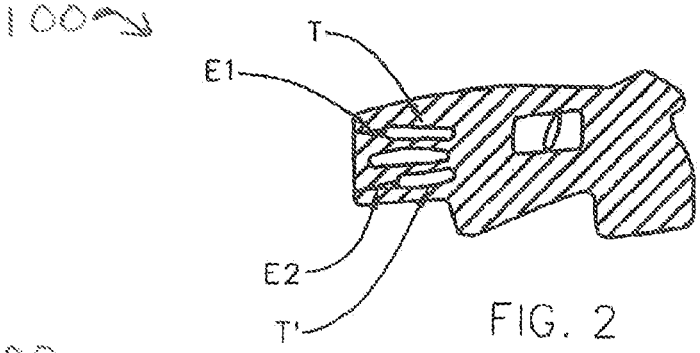
FIG. 2 is a cross-section of the system of FIG. 1 before ejecting tethered electrodes.

The cross-section of system 100, FIG. 2, indicates that inside system 100 are present electrodes E1 and E2 with tether wiring consisting of wire T and wire T'.

Figure 3:
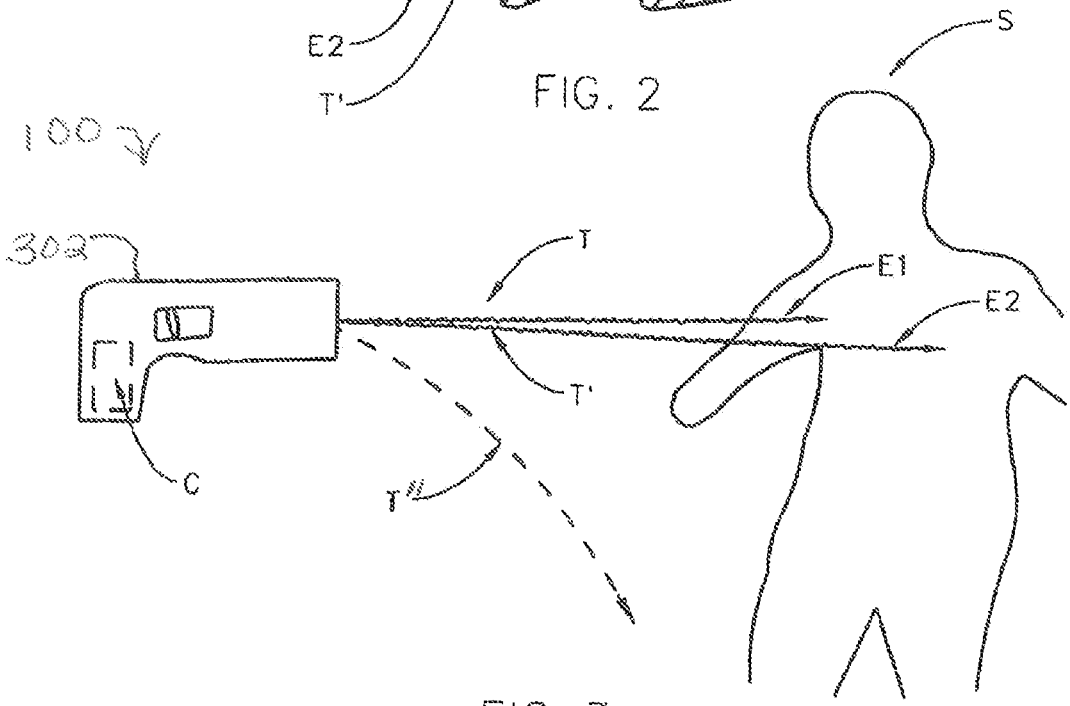
FIG. 3 is a perspective plan view of the system of FIGS. 1 and 2 applied to temporarily incapacitate a subject.

FIG. 3 shows the system of FIG. 1 operated to temporarily incapacitate a subject S. Tether wires T and T' connect body 302 to electrodes E1 and E2. Circuitry C, shown in FIGS. 1 and 3, provides electric shock and receives signals for monitoring a physiological function of subject S via at least one electrode E1 or E2. Circuitry C includes means for altering the characterizing parameters of a first or a follow-on electric shock so as to lessen the risk of injury to the subject. Altering is based on the monitored physiological function before, during, or after delivery of a first electric shock. Circuitry C also includes storage means for recording data resulting from monitoring the physiological function of the subject S.

Circuitry C of FIGS. 1 and 3 includes: means for monitoring a physiological function (which can include temperature, impedance, etc., as well as a cardiac function); means for monitoring a cardiac function resulting in ECG data; means for performing time domain and/or frequency domain analysis of ECG data; means for storing the results of the analysis; means for altering characterizing parameters of follow-on electric shocks; and storage means for recording data.

System 100, of FIG. 3, may operate with a tether wire T" implanted in earth ground, Preferably, both electrodes E1 and E2 implant into subject S.

U.S. Pat. Nos. 6,223,073, 5,954,664 and 5,655,540 to Seegobin are included herein by reference as they show that breaking ECG data into frequency bands provides time domain information not available directly from ECG data per se. Seegobin describes a system having ECG signal monitoring electrode means, any necessary interface such that data monitored by the ECG electrodes is fed to a memory device, computational means for performing necessary calculations and displaying results, and necessary interconnection and interfacing means. The system may be fashioned from essentially any computer system.

Finally, an electric shock delivery system may be implemented as self-contained "bullets" in which no tether wires are involved. That is, all battery, means for contacting a subject, means for delivering a shock, means for monitoring a signal, etc. are "on-board" a projectile. The teachings herein apply to such a tetherless system with the distinction that where signals are desired to be available at a distance from the self contained projectile, they are transmitted using means for wireless transmitting.

Having hereby disclosed the subject matter of the present invention, it should be obvious that many modifications, substitutions, and variations of the present invention are possible in view of these teachings. It is therefore to be understood that the invention may be practiced other than as specifically described, and should be limited in its breadth and scope only by the Claims.

I claim:

1. In a system for delivery of an electric shock to a subject for incapacitating the subject, the electric shock delivered via at least one electrode ballistically implanted by the system into the subject, the improvement comprising:

means for monitoring a physiological function of the subject via the electrode; and means for performing frequency domain analysis of a result of monitoring.

2. The system of claim 1 wherein the physiological function comprises a cardiac function.

3. The system of claim 2 wherein the result of monitoring comprises ECG data.

4. The system of claim 1 wherein the improvement further comprises means for altering a characterizing parameter for a follow-on electric shock in accordance with the result of performing.

5. The system of claim 1 wherein analysis is accomplished with respect to at least two frequency ranges.

6. The system of claim 1 wherein the improvement further comprises means for preventing delivery of a follow-on electric shock to the subject in accordance with the result of performing.

7. The system of claim 1 wherein the improvement further comprises means for recording a result of performing.

8. The system of claim 7 wherein the result of performing is in accordance with the physiological function at a time before delivery of the electric shock.

9. The system of claim 7 wherein the result of performing is in accordance with the physiological function at a time after delivery of the electric shock.

10. In a method performed by an electric shock delivery system for delivery of an electric shock to a subject for incapacitating the subject, the improvement comprising:

implanting at least one electrode onto or into the subject for delivery of the electric shock;

monitoring a physiological function of the subject via the electrode; and performing frequency domain analysis of a result of monitoring.

11. The method of claim 10 wherein performing is accomplished with respect to at least two frequency ranges.

12. The method of claim 10 wherein the improvement further comprises altering a characterizing parameter for a follow-on electric shock in accordance with a result of performing.

13. The method of claim 10 wherein the result of monitoring comprises ECG data.

14. The method of claim 10 wherein the improvement further comprises preventing delivery of a follow-on electric shock in accordance with a result of performing.

15. The method of claim 10 wherein the improvement further comprises recording a result of performing.

16. In a system for delivery of an electric shock to a subject for incapacitating the subject, the electric shock delivered via at least one electrode ballistically implanted by the system into the subject, the improvement comprising:

means for monitoring a physiological function of the subject via the electrode; and means for performing time domain analysis of a result of monitoring.

17. The system of claim 16 wherein the physiological function comprises a cardiac function.

18. The system of claim 17 wherein the result of monitoring comprise ECG data.

19. The system of claim 16 wherein the improvement further comprises means for recording a result of performing.

20. The system of claim 19 wherein the result of performing is in accordance with the physiological function at a time before delivery of the electric shock.

21. The system of claim 19 wherein the result of performing is in accordance with the physiological function at a time after delivery of the electric shock.

22. The system of claim 16 wherein the improvement further comprises means for altering a characterizing parameter for a follow-on electric shock in accordance with the result of performing.

23. The system of claim 16 wherein the improvement further comprises means for preventing delivery of a follow-on electric shock to the subject in accordance with the result of performing.

24. In a system for delivery of an electric shock to a subject for incapacitating the subject, the electric shock delivered via at least one electrode ballistically implanted by the system into the subject, the improvement comprising:

means for monitoring a physiological function of the subject via the electrode; and means for performing frequency domain analysis of a result of monitoring.

25. The system of claim 24 wherein the physiological function comprises a cardiac function.

26. The system of claim 25 wherein the result of monitoring comprises ECG data.

27. The system of claim 24 wherein the improvement further comprises means for recording a result of performing.

28. The system of claim 27 wherein the result of performing is in accordance with the physiological function at a time before delivery of the electric shock.

29. The system of claim 27 wherein the result of performing is in accordance with the physiological function at a time after delivery of the electric shock.

30. The system of claim 24 wherein the improvement further comprises means for altering a characterizing parameter for a follow-on electric shock in accordance with the result of performing.

31. The system of claim 24 wherein the improvement further comprises means for preventing delivery of a follow-on electric shock to the subject in accordance with the result of performing.

* * * * *